US006782870B2

(12) United States Patent
Ishida

(10) Patent No.: US 6,782,870 B2
(45) Date of Patent: Aug. 31, 2004

(54) FUEL INJECTION PUMP HAVING HYDRAULIC TIMER MECHANISM AND LOAD TIMER MECHANISM

(75) Inventor: Hiroki Ishida, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/668,233

(22) Filed: Sep. 24, 2003

(65) Prior Publication Data

US 2004/0060543 A1 Apr. 1, 2004

(30) Foreign Application Priority Data

Sep. 27, 2002 (JP) ..... 2002-284146

(51) Int. Cl.[7] ..... F02M 37/04
(52) U.S. Cl. ..... 123/449; 123/373
(58) Field of Search ..... 123/500, 501, 123/502, 373, 385, 386, 387, 449

(56) References Cited

U.S. PATENT DOCUMENTS 4,334,514 A * 6/1982 Konrath et al. ..... 123/502
4,469,066 A * 9/1984 Yuzawa ..... 123/380
4,483,297 A * 11/1984 Eheim et al. ..... 123/449
4,548,184 A * 10/1985 Laufer et al. ..... 123/568.18
4,819,606 A * 4/1989 Kawano ..... 123/502
5,105,786 A 4/1992 Kato
5,161,509 A 11/1992 Krieger et al.

FOREIGN PATENT DOCUMENTS

JP 57-119132 7/1982

* cited by examiner

*Primary Examiner*—Carl S. Miller
(74) *Attorney, Agent, or Firm*—Nixon & Vanderhye P.C.

(57) ABSTRACT

A load timer mechanism of a fuel injection pump includes a governor shaft, which is secured to a housing, and a governor sleeve, which is axially slidably supported around the governor shaft. The governor shaft includes a fuel relief passage, which is communicated with a low pressure side of the pump and has an outer opening in an outer peripheral surface of the governor shaft, and a first annular groove, which is recessed in the outer peripheral surface of the governor shaft such that the first annular groove is axially displaced from the outer opening. The governor sleeve includes a port, which extends between an outer peripheral surface and an inner peripheral surface of the governor sleeve, and a second annular groove, which is recessed in the inner peripheral surface of the governor sleeve such that the second annular groove is axially displaced from the port.

3 Claims, 5 Drawing Sheets

FUEL INJECTION PUMP HAVING HYDRAULIC TIMER MECHANISM AND LOAD TIMER MECHANISM

CROSS REFERENCE TO RELATED APPLICATION

This application is based on and incorporates herein by reference Japanese Patent Application No. 2002-284146 filed on Sep. 27, 2002.

BACKGROUND OF THE INVENTION

1. Field of the Invention

The present invention relates to a fuel injection pump and more particularly to a load timer mechanism of a fuel injection pump of a distributor type.

2. Description of Related Art

The emission regulation of diesel engines has become increasingly stringent due to the increasing environmental concern. In general, when the fuel injection timing of the diesel engine is retarded, the emission of NOx is reduced. However, when the fuel injection timing is retarded to reduce the emission of NOx, the engine power is disadvantageously reduced. To address such a problem, it is known to use of a load timer, which reduces the amount of timer advancement when the load of the engine is reduced to reduce the emission of NOx and noises without reducing the engine power under the high load condition where high engine power is required. Such a load timer is disclosed, for example, in Japanese Unexamined Patent Publication No. 57-119132.

In the prior art load timer, an orifice penetrates through a governor sleeve of a centrifugal governor, which is reciprocated according to the rotational speed of the engine. Furthermore, a fuel relief passage, which is communicated with a low pressure side of a fuel injection pump, is formed in a governor shaft, along which the governor sleeve is guided. Upon operation of the governor sleeve, when the orifice of the governor sleeve is communicated with the fuel relief passage of the governor shaft, fuel in a pump housing of the fuel injection pump is relieved into the low pressure side of the fuel injection pump through the orifice of the governor sleeve and the fuel relief passage of the governor shaft. When the fuel pressure in the pump housing is reduced, a timer piston of a hydraulic timer received in the pump housing is retarded. As a result, cam rollers, which are in rolling contact with a face cam of the fuel injection pump, are moved to retard the fuel injection timing.

However, in the prior art load timer, since the amount of timer advancement is reduced in the low load condition, misfire could occur to cause generation of white smoke emissions.

To address such a problem, according to the disclosure of Japanese Unexamined Patent Publication No. 57-119132, a solenoid valve, which opens and closes the fuel relief passage, is provided to limit timer retardation caused by the load timer under operating conditions where generation of white smoke is expected, for example, in a case of driving the vehicle at highlands or in a case of operating the engine at low coolant temperature conditions, such as at the time of engine cranking. However, due to the increasingly stringent emission regulation, the amount of emission of NOx needs to be further reduced. Thus, according to the disclosed technique, it is difficult to further improve, i.e., further increase the amount of timer retardation. That is, when the load timer is operated to further increase the timer retardation, the solenoid valve, which limits the timer retardation, is actuated. As a result, the amount of timer retardation is limited. In some cases, the load timer could become inoperable.

SUMMARY OF THE INVENTION

The present invention addresses the above disadvantages. Thus, it is an objective of the present invention to provide a fuel injection pump, which is capable of limiting the timer retardation in the low load range and the high load range and also capable of improving the timer retardation in the intermediate load range with a relatively simple structure.

To achieve the objective of the present invention, there is provided a fuel injection pump for an internal combustion engine. The fuel injection pump includes a pump housing, a hydraulic timer mechanism and a load timer mechanism. The pump housing defines a pump chamber therein. The hydraulic timer mechanism is received in the housing and adjusts fuel injection timing based on fuel pressure of the pump chamber. The load timer mechanism is received in the housing and adjusts the fuel injection timing based on a load of the engine. The load timer mechanism includes a governor shaft and a governor sleeve. The governor shaft is secured to the housing. The governor shaft includes a fuel relief passage and a first annular groove. The fuel relief passage is communicated with a low pressure side of the fuel injection pump and has an outer opening in an outer peripheral surface of the governor shaft. The first annular groove is recessed in the outer peripheral surface of the governor shaft such that the first annular groove is axially displaced from the outer opening of the fuel relief passage. The governor sleeve is axially slidably supported around the governor shaft and is moved back and forth relative to the governor shaft based on the load of the engine. The governor sleeve includes a port and a second annular groove. The port extends between an outer peripheral surface and an inner peripheral surface of the governor sleeve and includes an outer opening placed in the outer peripheral surface of the governor sleeve and an inner opening placed in the inner peripheral surface of the governor sleeve. The port conducts the fuel pressure of the pump chamber from the outer peripheral surface to the inner peripheral surface of the governor sleeve. The second annular groove is recessed in the inner peripheral surface of the governor sleeve such that the second annular groove is axially displaced from the port. When the governor sleeve is positioned within a predetermined axial range, the first annular groove and the second annular groove are at least partially overlapped one another to define a fuel pool therebetween. When the engine is in one of a full load condition and a high load condition, the first annular groove and the second annular groove are at least partially overlapped one another, and the fuel pool is not substantially communicated with the port to prevent substantial communication between the port and the fuel relief passage. When the engine is in one of a partial load condition and an intermediate load condition, the first annular groove and the second annular groove are at least partially overlapped one another, and the fuel pool is substantially communicated with the port to substantially communicate between the port and the fuel relief passage. When the engine in one of a no load condition and a low load condition, the first annular groove and the second annular groove are not substantially overlapped one another to prevent substantial communication between the port and the fuel relief passage.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

A fuel injection pump according to an embodiment of the present invention will be described with reference to the accompanying drawings.

Figure 1:
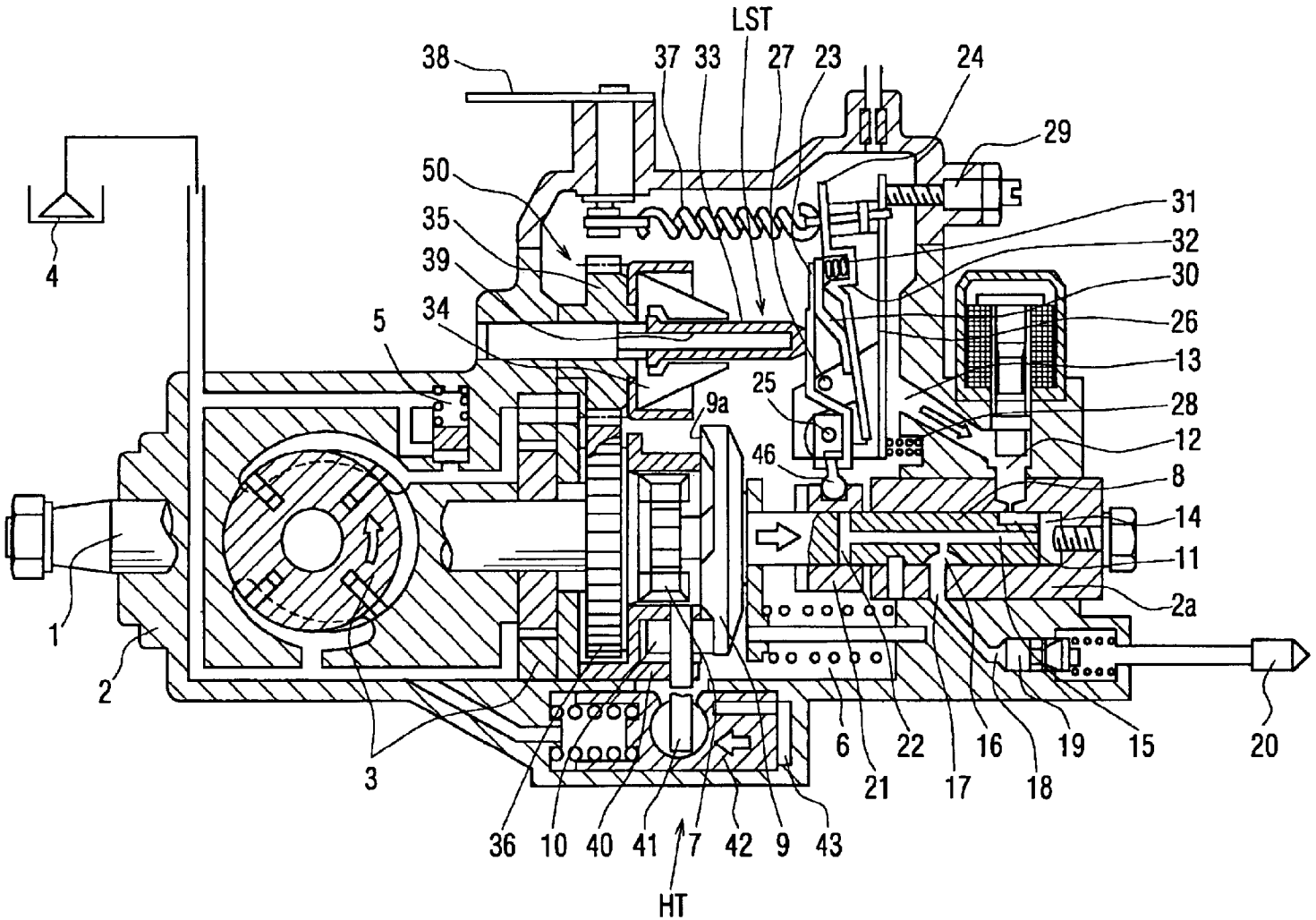
FIG. 1 is a cross sectional view of a fuel injection pump according to an embodiment of the present invention.

With reference to FIG. 1, the fuel injection pump according to the present embodiment includes a pump housing 2, a drive shaft 1, a rotary feed pump 3, a pressure regulator valve 5, a pump chamber 6 formed in the pump housing 2, a load timer mechanism LST and a hydraulic timer mechanism HT. The drive shaft 1 is connected to a crank shaft of a diesel engine (internal combustion engine), and rotational force is transmitted to the drive shaft 1 synchronously with rotation of the diesel engine. The drive shaft 1 rotates the feed pump 3 installed in the pump housing 2, so that the feed pump 3 pumps fuel from a fuel tank 4. The fuel, which is pumped by the feed pump 3, is supplied to the pressure regulator 5 where the pressure of the fuel is adjusted. Then, the fuel is supplied from the pressure regulator 5 to a pump chamber 6 formed in the pump housing 2. Specifically, the pressure regulator valve 5 is arranged between a pump chamber side (i.e., discharge outlet side) of the feed pump 3 and a low pressure side (i.e., the fuel tank 4 side) and adjusts the pressure of the fuel to a level that is proportional to a rotational speed of the feed pump 3. Here, it should be noted that FIG. 1 shows both a lateral view and a frontal view (i.e., view from the left side of FIG. 1) of the feed pump 3 for the sake of clarity.

In the present embodiment, the fuel located on the low pressure side communicated with the fuel tank 4 is referred to as low pressure fuel, and the fuel pumped by the feed pump 3 and is supplied to the pump chamber 6 is referred to as high pressure fuel. This high pressure fuel should be distinguished from high pressure fuel (pressurized fuel), which is pressurized by a plunger 8 (described below) to supply the fuel to the engine through a fuel injection valve 20.

As shown in FIG. 1, a face cam 9 is connected to the drive shaft 1 through a coupling 7 to rotate synchronously with the drive shaft 1 in an axially reciprocable manner. Furthermore, the plunger 8 is connected to an end of a base of the face cam 9 to rotate synchronously with the face cam 9. The coupling 7 transmits rotation of the drive shaft 1 to the plunger 8 and allows axial movement of the plunger 8.

As shown in FIG. 1, a cam profile 9*a* is formed in an end surface of the face cam 9, which is opposite from the end surface of the face cam 9, to which the plunger 8 is connected. The cam profile 9*a* of the face cam 9 includes a plurality of ridges, which are circumferentially arranged, and a number of the ridges corresponds to a number of cylinders of the engine. A plurality of cam rollers 10 are in rolling contact with the cam profile 9*a*. Through the rolling contact of the cam rollers 10 with the cam profile 9*a*, the face cam 9 and the plunger 8 reciprocate a plurality of times per rotation of the drive shaft 1, i.e., reciprocates a plurality of times, which coincide with the number of cylinders of the engine. The shape of the cam profile 9*a* is selected to achieve the best fuel injection pressure and fuel injection timing to meet a desired engine performance.

During the intake stroke of the plunger 8, the plunger 8 is axially moved in the left direction in FIG. 1. At this time, when one of a plurality of intake grooves 11, which are arranged along an outer peripheral surface of a distal end of the plunger 8, is communicated with an intake port 12, fuel of the pump chamber 6 is drawn into a pressurizing chamber 14, which is defined at the distal end of the plunger 8, through a guide passage 13.

During compression stroke of the plunger 8, the plunger 8 is axially moved in the right direction in FIG. 1. When the fuel of the pressurizing chamber 14 is pressurized, the pressurized fuel is guided into a longitudinal hole 15 defined in the plunger 8. At this time, the plunger 8 is rotated and is in sliding contact with a cylinder 2*a* formed in the housing 2. Upon rotation of the plunger 8, a supply port 16, which is opened in the outer peripheral surface of the plunger 8, is communicated with one of a plurality of discharge ports 17, which are opened in an inner peripheral surface of the cylinder 2*a*. Thus, the pressurized fuel is supplied from an injection passage 18 to the fuel injection valve 20 through a delivery valve 19.

A spill ring 21 is slidably fitted around the plunger 8. The spill ring 21 opens and closes a spill port 22 formed in the plunger 8. The spill port 22 is communicated with the longitudinal hole 15. During the pumping operation, i.e., during the pumping of the pressurized fuel from the longitudinal hole 15 to the fuel injection valve 20 through the supply port 16, the discharge port 17 and the injection passage 18, when the spill port 22 is opened by the spill ring 21, the fuel in the longitudinal hole 15, i.e., the pressurized fuel in the pressurizing chamber 14 is relieved from the spill port 22 to the pump chamber 6, so that the fuel pressure of the pressurized fuel is reduced. When the fuel pressure of the pressurized fuel is reduced to a level equal or below a valve closing pressure for closing the fuel injection valve 20, the fuel supply to the fuel injection valve 20 is stopped.

Figure 2:
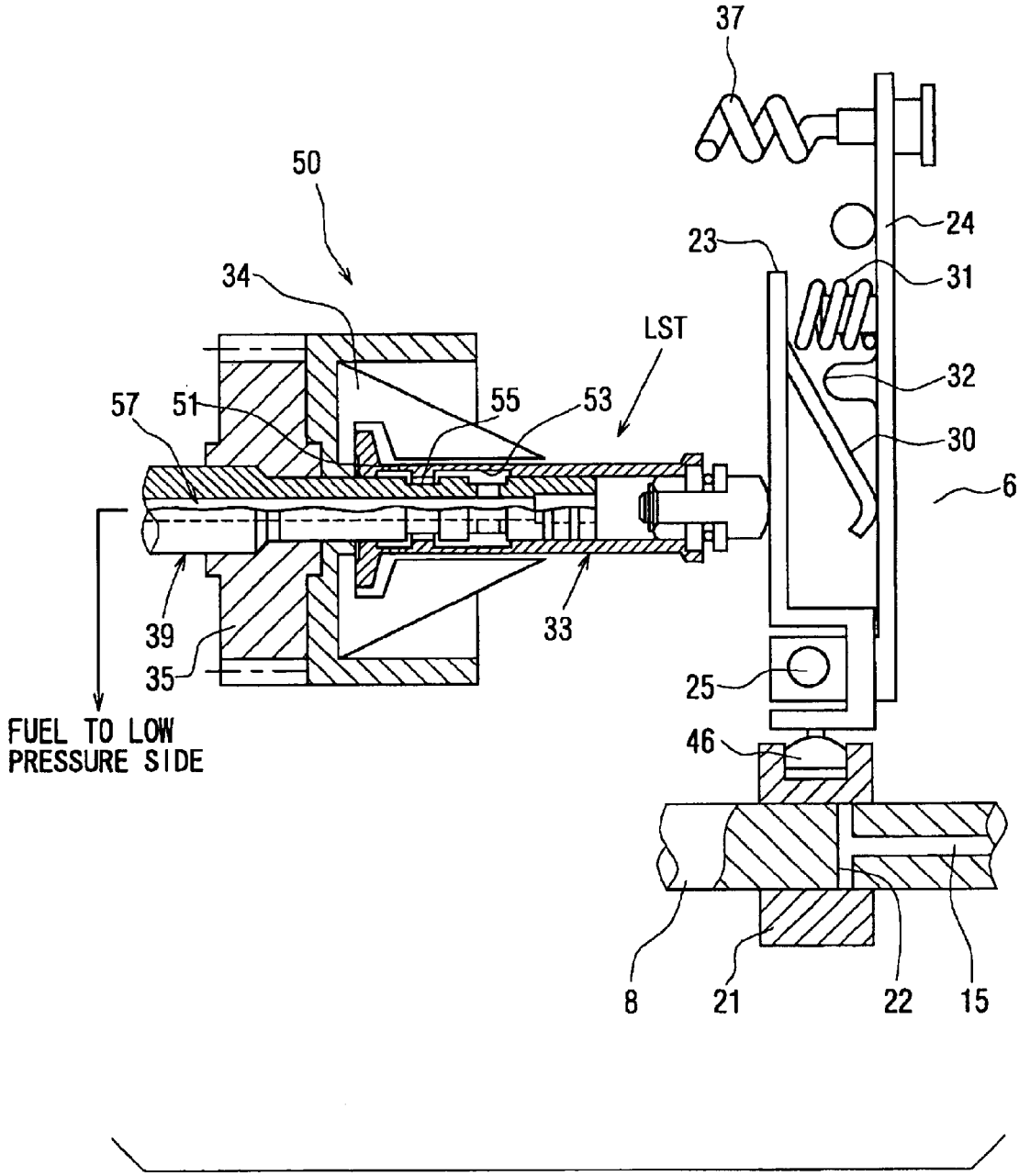
FIG. 2 is a partial cross sectional view schematically showing a load timer mechanism of the fuel injection pump.

As shown in FIGS. 1 and 2, the spill ring 21 is connected to a control lever 23 and a tension lever 24 through a joint 46. The control lever 23 and the tension lever 24 are rotatably connected to a guide lever 26 through a pin 25.

As shown in FIG. 1, the guide lever 26 is rotatably connected to another pin 27. The guide lever 26 is urged in one direction by an urging spring 28, and a top end of the guide lever 26 is engaged with a full load stopper 29 provided for adjusting the maximum amount of fuel injection.

As shown in FIGS. 1 and 2, the control lever 23 and the tension lever 24 are urged by a start spring 30 and an idle spring 31, which are provided between the control lever 23 and the tension lever 24, in opposite directions. A projection 32 is formed in the tension lever 24. When the projection 32 is connected with the control lever 23, the control lever 23 and the tension lever 24 are integrally rotated about the pin 25.

As shown in FIGS. 1 and 2, the control lever 23 can be pushed by a governor sleeve 33 of a centrifugal governor 50. The governor sleeve 33 is slidably guided along a governor shaft 39. As shown in FIGS. 1 and 2, the governor sleeve 33 experiences thrust upon rotation of flyweights 34. The flyweights 34 are connected to a governor gear 35. The governor gear 35 is meshed with a gear 36, which is integrally connected to the drive shaft 1. When the drive shaft 1 is rotated, the governor gear 35 is rotated through the gear 36, and centrifuge force is generated in the rotating flyweights 34. The generated centrifugal force of the flyweights 34 applies the thrust to the governor sleeve 33. That is, base ends of the rotating flyweights 34 push the governor sleeve 33 in the right direction in FIG. 1. In this way, the control lever 23 is pushed by the governor sleeve 33 according to the rotational speed of the engine. Thus, the control lever 23 is rotated about the pin 25 to axially move the spill ring 21 in the left direction in FIG. 1. Through the axial movement of the spill ring 21, the amount of fuel injection (hereinafter, referred to as the fuel injection amount) is adjusted. The centrifugal governor 50 includes the governor sleeve 33, the governor shaft 39 and the flyweights 34. A governor control means for adjusting the fuel injection amount based on the rotational speed of the engine or an amount of shift of an accelerator pedal (hereinafter, referred to as an accelerator pedal shift amount) includes the control lever 23, the tension lever 24, the guide lever 26 and the control spring 37.

A load timer mechanism (load sensing timer) LST, which will be described later, is formed by the governor sleeve 33 and the governor shaft 39. Thus, the load sensing timer LST includes the governor sleeve 33 and the governor shaft 39. Detail of the load sensing timer LST will be described later.

One end of the control spring 37 is connected to a top end of the tension lever 24, and the other end of the control spring 37 is connected to a manipulation lever 38. The manipulation lever 38 is actuated by the accelerator pedal (not shown). When the manipulation lever 38 is rotated by the accelerator pedal, the tension lever 24 is rotated about the pin 25 through the control spring 37. Thus, the spill ring 21 is axially moved. In this way, the fuel injection amount can be controlled by the accelerator pedal shift amount.

Next, the hydraulic timer mechanism HT will be described with reference to FIG. 1. The cam rollers 10, which are in rolling contact with the face cam 9, are supported by a roller ring 40. The roller ring 40 is connected to a timer piston 42 through a rod 41. The timer piston 42 is received in a timer pressure chamber 43 defined in the pump housing 2, and fuel pressure of the pump chamber 6 is introduced into the timer chamber 43.

When the fuel pressure of the timer pressure chamber 43 is varied according to the fuel pressure of the pump chamber 6, the timer piston 42 is axially displaced, and the axial displacement of the timer piston 42 causes rotation of the roller ring 40. Thus, the cam rollers 10 are circumferentially displaced relative to the face cam 9, so that time for initiating engagement between the cam rollers 10 and the corresponding ridges of the face cam 9 is varied accordingly. As a result, timing of fuel injection is varied.

It should be noted that although the timer piston 42 and the timer pressure chamber 43 are oriented in the left-right direction in FIG. 1 for the sake of clarity, the timer piston 42 and the timer pressure chamber 43 are actually oriented in a direction perpendicular to the plane of FIG. 1.

Here, the hydraulic timer mechanism HT includes the timer piston 42 and the timer pressure chamber 43.

Figure 3:
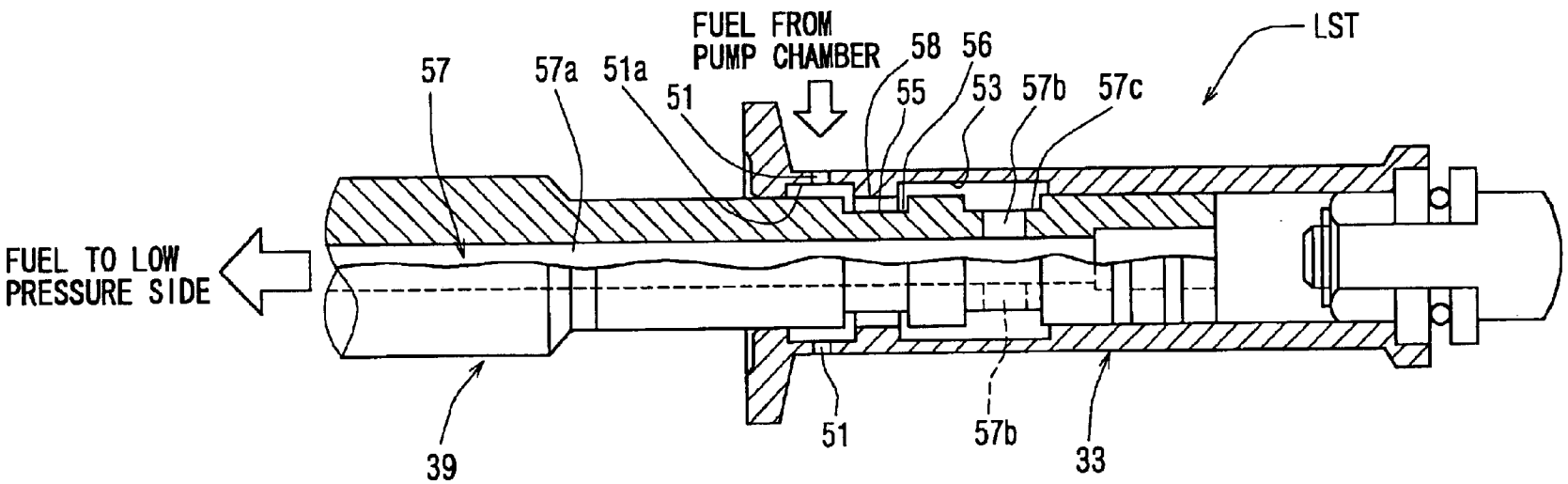
FIG. 3 is a partial cross sectional view showing a main feature of the load timer mechanism.

Next, the structure of the load sensing timer LST will be described with reference to FIGS. 1 to 5. As shown in FIG. 1, the governor shaft 39 is securely supported by the pump housing 2 such that the governor shaft 39 is generally parallel to the drive shaft 1 to mesh the governor gear 35 with the gear 36. As shown in FIGS. 2 and 3, a fuel relief passage 57 is defined in the governor shaft 39. The fuel relief passage 57 includes a longitudinal hole 57*a* and two diametrically opposed radial holes 57*b*. The longitudinal hole 57*a* axially extends in the governor shaft 39. The radial holes 57*b* radially extend from a distal end of the longitudinal hole 57*a* to an outer peripheral surface of the governor shaft 39. With reference to FIG. 1, a proximal end of the longitudinal hole 57*a* is communicated with the fuel in the low pressure side, i.e., the fuel tank 4 side of the feed pump 3. The radial holes 57*b* are not limited to the through holes shown in FIG. 3. For example, in place of the two radial holes 57*b*, it is possible to provide a single radial hole, which radially extends from the longitudinal hole 57*a* to the outer peripheral surface of the governor shaft 39. Further alternatively, in place of the two radial holes 57*b*, it is possible to provide more than two radial holes as long as the radial holes are placed in the same axial position along the governor shaft 39.

In the present embodiment, an opening-side annular groove 57*c*, which can be regarded as a part of the outer opening of each radial hole 57*b*, is recessed in a portion of the outer peripheral surface of the governor shaft 39 where the outer openings of the radial holes 57*b* are located, as shown in FIG. 1. In this case, it is not necessary to place the outer openings of the radial holes 57*b* in the same axial position of the governor shaft 39. As long as the outer openings of the radial holes 57*b* are located within an axial extent of the opening-side annular groove 57*c*, the outer openings of the radial holes 57*b* can be displaced in the axial direction.

As described above, the governor sleeve 33 can be moved back and forth, i.e., can be reciprocated in the axial direction of the governor shaft 39 by the centrifugal force of the flyweights 34, which varies according to the rotational speed of the engine or the load of the engine. As shown in FIG. 3, two diametrically opposed ports 51 are provided in the governor sleeve 33 at a predetermined axial position of the governor sleeve 33. Each port 51 extends from an inner peripheral surface to an outer peripheral surface of the governor sleeve 33 and includes an inner opening placed in the inner peripheral surface of the governor sleeve 33 and an outer opening placed in the outer peripheral surface of the governor sleeve 33. The ports 51 are not limited to the through holes shown in FIG. 3. For example, in place of the two ports 51, it is possible to provide a single port, which radially extends from the inner peripheral surface to the outer peripheral surface of the governor sleeve 33. Further alternatively, in place of the two ports 51, it is possible to provide more than two ports as long as the ports are placed in the same axial position along the governor sleeve 33.

In the present embodiment, as shown in FIG. 3, in the portion of the inner peripheral surface of the governor sleeve 33 where the inner opening of the ports 51 are located, an opening-side annular groove 51*a*, which can be regarded as a part of the inner opening of each port 51, is recessed in the inner peripheral surface of the governor sleeve 33. In this case, the inner openings of the ports 51 are not necessarily located in the same axial position of the governor sleeve 33. That is, as long as the inner openings of the ports 51 are located within an axial extent of the annular groove 51*c*, the inner openings of the ports can be axially displaced.

As shown in FIG. 3, each radial hole 57*b* of the fuel relief passage 57 and each port 51 can be communicated one another and can be discommunicated from one another by the reciprocal movement of the governor sleeve 33 induced by the centrifugal force of the flyweights 34, which varies according to the load of the engine. As a result, based on the operational state of the engine, it is possible to relieve the high pressure fuel of the pump chamber 6 to the low pressure side through the port 51 and the radial hole 57*b* upon communication between the port 51 and the radial hole 57*b*, and it is also possible to stop the relief of the high pressure fuel of the pump chamber 6 to the low pressure side upon discommunication between the port 51 and the radial hole 57*b*. Through the communication and discommunication between the radial hole 57*b* and the port 51, which are achieved according to the operational state of the engine, the fuel pressure of the pump chamber 6, which acts as a drive source of the timer mechanism HT for adjusting the fuel injection timing, is reduced and is maintained. As a result, through the communication and discommunication between the radial hole 57*b* and the port 51, i.e., through the actuation of the load sensing timer LST, the fuel injection timing (specifically, the fuel injection timing controlled based on the high pressure fuel, which is adjusted to the pressure that is proportional to the rotational speed of the engine by actuation of the pressure regulator valve 5) is controlled based on the load condition of the engine.

Figure 5:
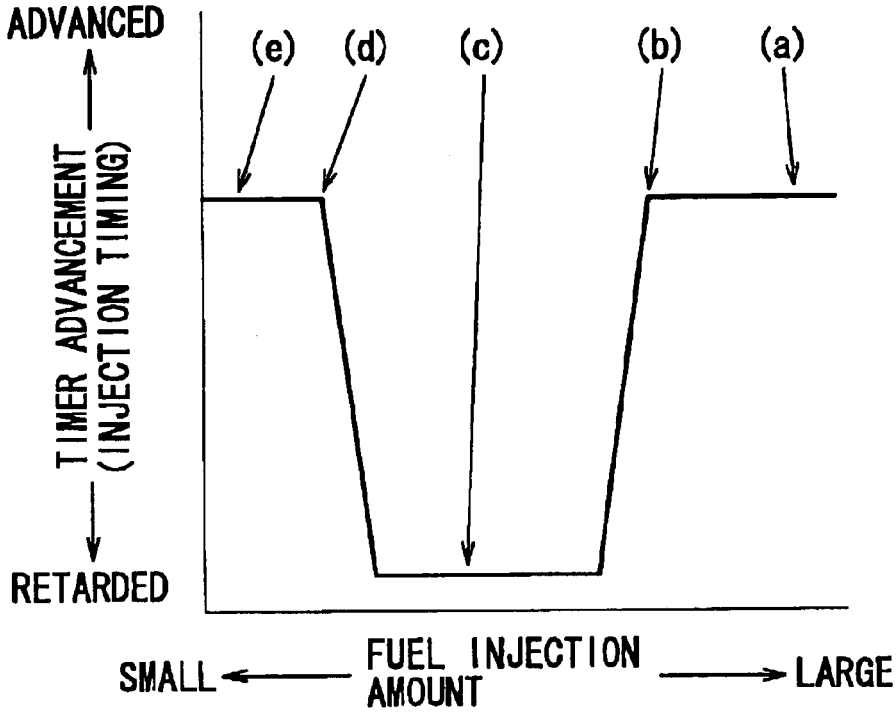
FIG. 5 is a graph showing a relationship between the fuel injection amount and timer advancement, which correspond to the fuel injection timing.

Furthermore, in the present embodiment, a first annular groove 55 is formed in the outer peripheral surface of the governor shaft 39 at an axial position that is displaced from the axial position of the outer opening of each radial hole 57*b*, as shown in FIG. 3. A second annular groove 53 is formed in the inner peripheral surface of the governor sleeve 33 at an axial position that is displaced from the axial position of the inner opening of each port 51, as shown in FIG. 3. When the governor sleeve 33 is placed within a predetermined axial range through the reciprocal movement of the governor sleeve 33, the first annular groove 55 and the second annular groove 53 are at least partially overlapped one another to communicate between the port 51 and the radial hole 57*b* through a fuel pool 56 defined between the first annular groove 55 and the second annular groove 53 (FIG. 1 and a point "c" in FIG. 5). Detail of the communication and discommunication between the radial hole 57*b* and the port 51, i.e., the actuation of the load sensing timer LST will be described later.

Next, operation of the fuel injection pump, particularly of the load sensing timer will be described with reference to FIGS. 1, 4 and 5. FIG. 5 shows a relationship between the fuel injection amount and timer advancement, which correspond to the fuel injection timing.

Figure 4A:
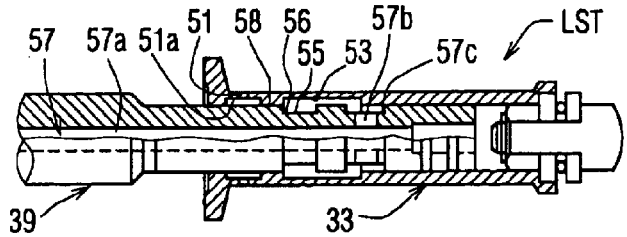
FIG. 4A is a cross sectional view schematically showing a governor sleeve in a high load condition.

In a high load condition or a full load condition of the engine, the accelerator pedal is operated to rotate the manipulation lever 38 (FIG. 1) forward, so that the tension lever 24 is rotated or pivoted through the control spring 37 in a counterclockwise direction (in the left direction in FIG. 1). As a result, the spill ring 21 is axially moved toward the right side in FIG. 1, and thereby the fuel injection amount is increased. In this case, the axial position of the governor sleeve 33 is limited by the control lever 23 and is thus axially positioned leftward in FIG. 1, as shown in FIG. 4A. At this time, the first annular groove 55 and the second annular groove 53 are overlapped one another. Furthermore, the governor sleeve 33 is axially held relative to the governor shaft 39 such that the fuel pool 56, which is at least partially defined by the first annular groove 55 and the second annular groove 53, is not communicated with the port 51. Thus, the port 51 and the radial hole 57*b* are not communicated one another, and thus the fuel pressure of the pump chamber 6 is not reduced. Therefore, the fuel pressure of the pump chamber 6 is maintained at the relatively high pressure. As a result, the timer piston 42 of the timer mechanism HT is pushed toward the timer advance side by the pressure of the timer pressure chamber 43, which is exerted by the maintained fuel pressure of the pump chamber 6, so that the amount of timer advancement is increased, i.e., the fuel injection timing is advanced (this state corresponds to a point "a" in FIG. 5).

Figure 4B:
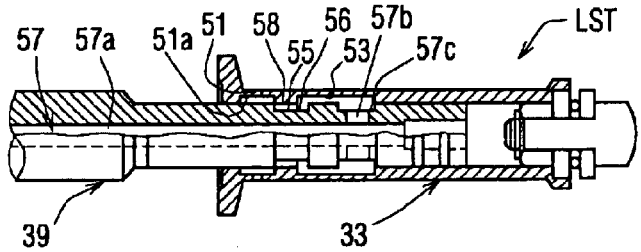
FIG. 4B is a cross sectional view schematically showing the governor sleeve in a transitional range between the high load condition and an intermediate load condition.

When the accelerator pedal is operated to slightly rotate the manipulation lever 38 backward to reduce the load of the engine, the tension lever 24 is rotated or pivoted by the control spring 37 in a clockwise direction (in the right direction in FIG. 1). As a result, the spill ring 21 is moved in the left direction in FIG. 1, so that the fuel injection amount is reduced accordingly. In this state, the governor sleeve 33 is released from the control lever 23. The centrifugal force of the flyweights 34 of the governor 50 causes the governor sleeve 33 to move from the position of FIG. 4A in the right direction, as shown in FIG. 4B. At this time, the first annular groove 55 and the second annular groove 53 are still at least partially overlapped one another like the state of FIG. 4A. However, in this state, the opening-side annular groove 51*a* and the first annular groove 55 can be slightly overlapped one another without causing substantial communication between the inner opening of the port 51 (specifically, the opening-side annular groove 51*a*) and the first annular groove 55. Even in such a case, the port 51 and the first annular groove 55 are not substantially communicated one another due to characteristics (such as viscosity) of the fuel as long as an opening area at the overlapped region between the opening-side annular groove 51*a* and the first annular groove 55 is sufficiently small. The axial position of the governor sleeve 33 shown in FIG. 4B corresponds to a transitional point (a point "b" in FIG. 5) from the highly advanced state of the fuel injection timing, which is achieved under the high load condition, to a retarded state of the fuel injection timing, which is achieved under an intermediate load condition (or partial load condition) and is retarded from the fuel injection timing achieved under the high load condition.

Figure 4C:
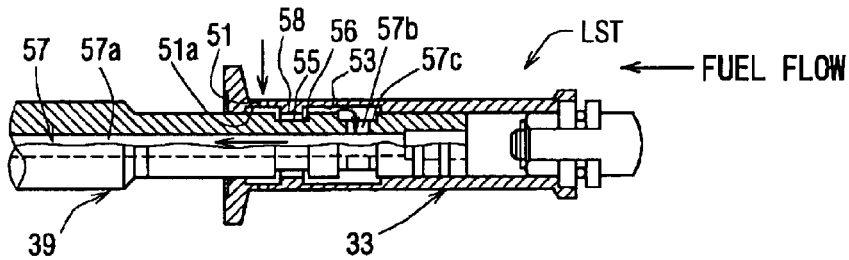
FIG. 4C is a cross sectional view schematically showing the governor sleeve in the intermediate load condition.
Figure 4D:
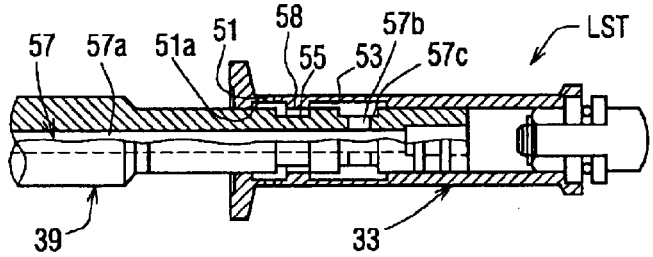
FIG. 4D is a cross sectional view schematically showing the governor sleeve in another transitional range between the intermediate load condition and a low load condition.

When the load of the engine is further reduced to achieve the intermediate load condition of the engine, the governor sleeve 33 is moved from the position of FIG. 4B in the right direction, as shown in FIG. 4C, due to the centrifugal force of the flyweights 34. At this time, similar to the states of FIGS. 4A and 4B, the first annular groove 55 and the second annular groove 53 are still at least partially overlapped one another. Furthermore, the fuel pool 56 and the port 51 (specifically, the first annular groove 55 and the opening-side annular groove 51*a*) are overlapped one another. Thus, a decrease of the fuel pressure can be achieved in the pump chamber 6, and a rate of the decrease of the fuel pressure depends on a cross sectional area of the opening of the port 51. Therefore, the fuel injection timing under the intermediate load condition can be retarded from the fuel injection timing under the high load condition.

Figure 4E:
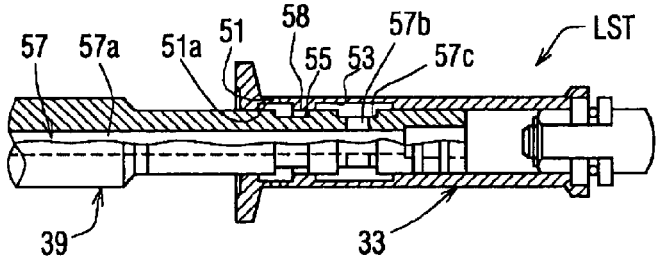
FIG. 4E is a cross sectional view schematically showing the governor sleeve in the low load condition.

Furthermore, when the load of the engine is further reduced to achieve a low load condition (or no load condition) of the engine, the governor sleeve 33 is moved from the position of FIG. 4C in the right direction, as shown in FIG. 4E, due to the centrifugal force of the flyweights 34 of the governor 50. At this time, the first annular groove 55 and the second annular groove 53 are slightly overlapped one another or are not overlapped one another. Thus, the port 51 and the radial hole 57*b* are not substantially communicated one another. As a result, the fuel injection timing can be substantially returned from the retarded state, which is achieved under the intermediate load condition, to the fuel injection timing similar to one achieved under the high load condition.

In this way, it is possible to communicate between the port 51 and the radial hole 57*b* only under the intermediate load condition to retard the fuel injection timing in comparison to the fuel injection timing under the high load condition. Furthermore, this can be achieved by providing the first annular groove 55 and the second annular groove 53 in addition to the fuel relief passage 57 (i.e., the longitudinal hole 57*a* and radial holes 57*b*) and the ports 51. Thus, with the simple structure achieved by the slight structural modification of a previously proposed structure, the fuel injection timing under the low load condition is limited, and the timer retardation in the intermediate load range can be improved.

Furthermore, in the present embodiment, the opening of each port 51 and the opening of each radial hole 57*b* are formed by the opening-side annular groove 51*a* and the opening-side annular groove 57*c*, respectively. Thus, the variation in the cross sectional area of the opening formed in the overlapped region between the opening-side annular groove 51*a* and the opening-side annular groove 57*c* upon reciprocal movement of the sleeve 30 can be increased in comparison to the circular hole or rectangular hole (see the transitional region from the high load condition to the intermediate load condition located in the point "b" of FIG. 5 and the transitional region from the intermediate load condition to the low load condition in the point "d" of FIG. 5). As a result, with respect to the desired intermediate load range, the movable range of the governor sleeve 33, which allows the communication between the port 51 and the radial hole 57*b*, is increased. Thus, the timer retardation in the desired intermediate load range, i.e., the retardation of the fuel injection timing in the desired intermediate load range is further improved.

Furthermore, in the present embodiment, as shown in FIG. 3 and the point "C" of FIG. 5, the axial extent (width) of the first annular groove 55 is larger than an axial extent (width) of a protrusion 58 formed between the inner opening (specifically, the opening-side annular groove 51*a*) of the port 51 and the second annular groove 53. With this arrangement, it is possible to maintain the discommunication between the port 51 and the fuel pool 56 from the position (high load condition) of FIG. 4A to the position (transitional point) of FIG. 4B, at which a left end wall of the first annular groove 55 is overlapped with a left end wall of the protrusion 58. Furthermore, it is possible to maintain the discommunication between the first annular groove 55 and the second annular groove 53 from the position (transitional point) of FIG. 4D to the position (low load condition) of FIG. 4E, at which a right end wall of the first annular groove 55 is overlapped with a right end wall of the protrusion 58. As a result, by setting the axial extent of the first annular groove 55, which is formed in the outer peripheral surface of the governor shaft 39, larger than the axial extent of the protrusion 58, which is formed in the inner peripheral surface of the governor sleeve 33, it is possible to provide the load sensing timer LST, which limits the timer retardation in the low load range and improves the timer retardation in the intermediate load range, without causing a substantial increase in the manufacturing costs.

Additional advantages and modifications will readily occur to those skilled in the art. The invention in its broader terms is therefore not limited to the specific details, representative apparatus, and illustrative examples shown and described.

What is claimed is:

1. A fuel injection pump for an internal combustion engine, the fuel injection pump comprising:

a pump housing that defines a pump chamber therein;

a hydraulic timer mechanism that is received in the housing and adjusts fuel injection timing based on fuel pressure of the pump chamber; and a load timer mechanism that is received in the housing and adjusts the fuel injection timing based on a load of the engine, wherein the load timer mechanism includes:

a governor shaft that is secured to the housing, wherein the governor shaft includes:

a fuel relief passage that is communicated with a low pressure side of the fuel injection pump and has an outer opening in an outer peripheral surface of the governor shaft; and a first annular groove that is recessed in the outer peripheral surface of the governor shaft such that the first annular groove is axially displaced from the outer opening of the fuel relief passage; and a governor sleeve that is axially slidably supported around the governor shaft and is moved back and forth relative to the governor shaft based on the load of the engine, wherein the governor sleeve includes:

a port that extends between an outer peripheral surface and an inner peripheral surface of the governor sleeve and includes an outer opening placed in the outer peripheral surface of the governor sleeve and an inner opening placed in the inner peripheral surface of the governor sleeve, wherein the port conducts the fuel pressure of the pump chamber from the outer peripheral surface to the inner peripheral surface of the governor sleeve; and a second annular groove that is recessed in the inner peripheral surface of the governor sleeve such that the second annular groove is axially displaced from the port, wherein:

when the governor sleeve is positioned within a predetermined axial range, the first annular groove and the second annular groove are at least partially overlapped one another to define a fuel pool therebetween;

when the engine is in one of a full load condition and a high load condition, the first annular groove and the second annular groove are at least partially overlapped one another, and the fuel pool is not substantially communicated with the port to prevent substantial communication between the port and the fuel relief passage;

when the engine is in one of a partial load condition and an intermediate load condition, the first annular groove and the second annular groove are at least partially overlapped one another, and the fuel pool is substantially communicated with the port to substantially communicate between the port and the fuel relief passage; and when the engine in one of a no load condition and a low load condition, the first annular groove and the second annular groove are not substantially overlapped one another to prevent substantial communication between the port and the fuel relief passage.

2. The fuel injection pump according to claim 1, wherein at least one of the inner opening of the port and the outer opening of the fuel relief passage is formed as an annular groove.

3. The fuel injection pump according to claim 1, wherein:

the governor sleeve further includes a protrusion, which is formed in the inner peripheral surface of the governor sleeve between the inner opening of the port and the second annular groove; and an axial extent of the first annular groove is larger than an axial extent of the protrusion of the governor sleeve.

* * * * *